US006171027B1

(12) United States Patent
Blankestijn

(10) Patent No.: US 6,171,027 B1
(45) Date of Patent: Jan. 9, 2001

(54) CANTILEVERED JACK-UP PLATFORM

(75) Inventor: Enrico Pedro Blankestijn, Zeist (NL)

(73) Assignee: Marine Structure Consultants (MSC) B.V., Zeist (NL)

( * ) Notice: Under 35 U.S.C. 154(b), the term of this patent shall be extended for 0 days.

(21) Appl. No.: 09/143,091

(22) Filed: Aug. 28, 1998

(30) Foreign Application Priority Data

Aug. 29, 1997 (NL) ..... 1006889

(51) Int. Cl.[7] ..... E02B 17/00; E02B 17/08

(52) U.S. Cl. ..... 405/201; 405/196; 405/203; 405/208; 175/5; 175/8

(58) Field of Search ..... 405/196, 199, 405/201, 203, 204, 208; 175/5, 7, 8, 9

(56) References Cited

U.S. PATENT DOCUMENTS

| | | | | |
|---|---|---|---|---|
| 1,128,039 | * | 2/1915 | Piercy | 405/201 |
| 3,033,525 | * | 5/1962 | Johnson | 405/201 X |
| 3,442,340 | * | 5/1969 | Christenson | 175/8 |
| 3,477,235 | | 11/1969 | Branham et al. . | |
| 3,638,338 | * | 2/1972 | Nelson | 37/308 |
| 4,065,934 | * | 1/1978 | Dysarz | 405/196 |
| 4,103,503 | * | 8/1978 | Smith | 405/196 |
| 4,224,005 | * | 9/1980 | Dysarz | 405/196 |
| 4,483,644 | * | 11/1984 | Johnson | 405/201 |
| 4,602,894 | * | 7/1986 | Lorenz et al. | 405/203 |
| 4,907,912 | * | 3/1990 | Smith | 405/208 |
| 4,913,592 | * | 4/1990 | Petty et al. | 405/199 |
| 4,938,628 | * | 7/1990 | Ingle | 405/196 X |
| 5,052,860 | * | 10/1991 | Ingle | 405/196 X |

FOREIGN PATENT DOCUMENTS

| | | |
|---|---|---|
| 2724958 | 12/1978 | (DE) . |
| 1089313 | 11/1967 | (GB) . |

* cited by examiner

*Primary Examiner*—Thomas B. Will
*Assistant Examiner*—Jong-Suk Lee
(74) *Attorney, Agent, or Firm*—Pillsbury Madison & Sutro LLP

(57) ABSTRACT

A drilling rig, in particular for the offshore industry, in the form of a jack-up platform on which a cantilever is mounted so as to be movable at least substantially horizontally and in a first direction, with the cantilever projecting more or less outside the jack-up platform. On the cantilever a drilling platform is present, which drilling platform is movable relative to the jack-up platform in a second direction, different herefrom. This drilling platform is fixedly mounted on the cantilever while the latter is movable relative to the jack-up platform in both abovesaid directions.

13 Claims, 7 Drawing Sheets

CANTILEVERED JACK-UP PLATFORM

FIELD OF THE INVENTION

The present invention relates to a drilling rig in the form of a jack-up platform on which a cantilever is mounted so as to be movable at least substantially horizontally and in a first direction, with the cantilever projecting more or less outside the jack-up platform, while a drilling platform is further present on the cantilever, said drilling platform being movable relative to the jack-up platform in a second direction, different herefrom.

BACKGROUND TO PRESENT INVENTION

In the conventional drilling rigs, the cantilever is movable only in its longitudinal direction relative to the jack-up platform, and the drilling platform is movable relative to the cantilever in a direction transverse thereto. Due to the resulting movement of the drilling platform relative to the jack-up platform, the drilling point of the drilling rig can reach any point located in a rectangle of which the lengths of the sides are determined by the travel of the cantilever relative to the jack-up platform and the travel of the drilling platform relative to the cantilever. However, in the transverse direction, the size of this rectangle is limited by the distance between the cantilever beams extending in the longitudinal direction, which beams determine the width of the cantilever. Located under the drilling platform is a grid of drilling points. The drilling platform with the blow-out valve and a part of the equipment, tools and materials for drilling that are further required moves from one drilling well to the other. The transverse movement of the drilling platform is limited by the cantilever beams. As a consequence, the drilling pattern is limited to drillings within said rectangle. To obtain a drilling pattern which is nevertheless acceptable, the cantilever should be of a relatively wide design. If the drilling platform has moved over the maximal distance in the transverse direction, the cantilever beam on the side to which this movement took place is subjected to a considerably heavier load than the other cantilever beam. Because of such asymmetric load on the cantilever beams occurring in practice, these beams should be of a relatively heavy construction. A further drawback of the conventional rigs is that between jack-up platform and cantilever, as well as between cantilever and drilling platform, flexible connections should be provided for pipes, cable work, etc.

SUMMARY AND OBJECTS OF THE INVENTION

The object of the invention is to provide a drilling rig wherein the above-mentioned drawbacks are avoided at least to a considerable extent. To this end, according to the invention, the drilling rig as described in the opening paragraph is characterized in that the drilling platform is fixedly mounted on the cantilever and said cantilever is movable relative to the jack-up platform in both abovementioned directions.

As a result, the drilling point always remains in the same place relative to the cantilever, viz. preferably centrally between the two cantilever beams. This leads to a symmetric load on the cantilever beams and offers the possibility of giving them a lighter construction. Now, the width of the cantilever can be selected independently of the displacement in the transverse direction and can be slighter without the drilling pattern being limited thereby. On the contrary, by increasing the movement possibility of the cantilever in the transverse direction, a larger drilling pattern can be obtained than is possible with the conventional drilling rigs. The construction according to the invention further has the advantage that flexible connections for pipes, cable work, etc. must only be provided between the jack-up platform and cantilever.

Although the cantilever with the drilling platform is movable in two directions by extending the cantilever in its longitudinal direction and rotating it about a fixed point on the jack-up platform, the cantilever is preferably constructed for movement in its longitudinal direction with the cantilever projecting more or less outside the jack-up platform, and in a direction relative to the jack-up platform which is transverse hereto. To enable these movements in an efficient manner, supporting members for the cantilever are present, which supporting members are movable with the cantilever in the transverse direction over rails secured on the jack-up platform, while the cantilever is supported by the supporting members for movement in the longitudinal direction.

In a concrete embodiment, the supporting members are slidable by means of relevant operating cylinders over rails secured on the jack-up platform and extending in the transverse direction, relative to slide members which can be secured on these rails, when they are at least secured thereon.

When the supporting members slide over the rails on the jack-up platform or the rails of the cantilever slide over the supporting members, considerable shearing forces occur. In order to at least partially relieve the parts sliding over each other in this regard, at least the two supporting members that are movable over the rail located closest to the edge of the jack-up platform may comprise friction-reducing means which are operative in the longitudinal direction as well as in the transverse direction, to take up at least a part of the frictional forces between the supporting members and the relevant rail and between the rails of the cantilever and the relevant supporting members. In a concrete embodiment, these friction-reducing means are formed by pairs of rollers which are freely movable between the supporting members and the rails in the direction of the rails and pressed thereagainst. In this regard, it is advantageous when the pressure exerted on the relevant rails by the friction-reducing means is settable.

It may sometimes be desirable to provide the drilling platform on a separate support platform. With the drilling rig according to the prior art, this is possible by providing a separate support construction on the separate support platform, onto which support construction the drilling platform can be slid from the cantilever. In practice, this proves to be a fairly difficult operation. For that reason, according to another aspect of the present invention, coupling means may be present whereby the drilling platform is detachably connected to the cantilever so that it can be positioned on a separate support platform. Due to the movability in height direction of the jack-up platform and the movability of the cantilever, both in the longitudinal direction and in the transverse direction, an accurate positioning of the drilling platform coupled to the cantilever is possible. By moreover constructing the coupling means such that the drilling platform can be hooked on laterally by the cantilever, it becomes possible, after the drilling platform has been placed on the separate support platform by a downward movement of the jack-up platform, to uncouple the drilling platform from the cantilever through a further downward movement of the jack-up platform and, subsequently, a withdrawing movement of the cantilever.

In the drilling rig according to the prior art, the high-pressure dredge pumps associated with such rig are typically arranged on the jack-up platform and relatively costly flexible high-pressure lines are necessary both between the jack-up platform and the cantilever and between the cantilever and the drilling platform.

Because according to the invention, the drilling platform is fixedly connected to the cantilever, one set of flexible high-pressure lines can be replaced by so much cheaper fixed high-pressure lines.

BRIEF DESCRIPTION OF THE FIGURES 1–8

Hereinafter, an exemplary embodiment of the present invention will be specified with reference to the accompanying drawings, wherein.

DETAILED DESCRIPTION OF THE INVENTION

A drilling rig, in particular for the offshore industry, in the form of a jack-up platform on which a cantilever is mounted so as to be movable at least substantially horizontally and in a first direction, with the cantilever projecting more or less outside the jack-up platform. On the cantilever a drilling platform is present, which drilling platform is movable relative to the jack-up platform in a second direction, different herefrom. This drilling platform is fixedly mounted on the cantilever while the latter is movable relative to the jack-up platform in both abovesaid directions.

More particularly, embodiments of the invention are now described with reference to the Figures.

Figure 1:
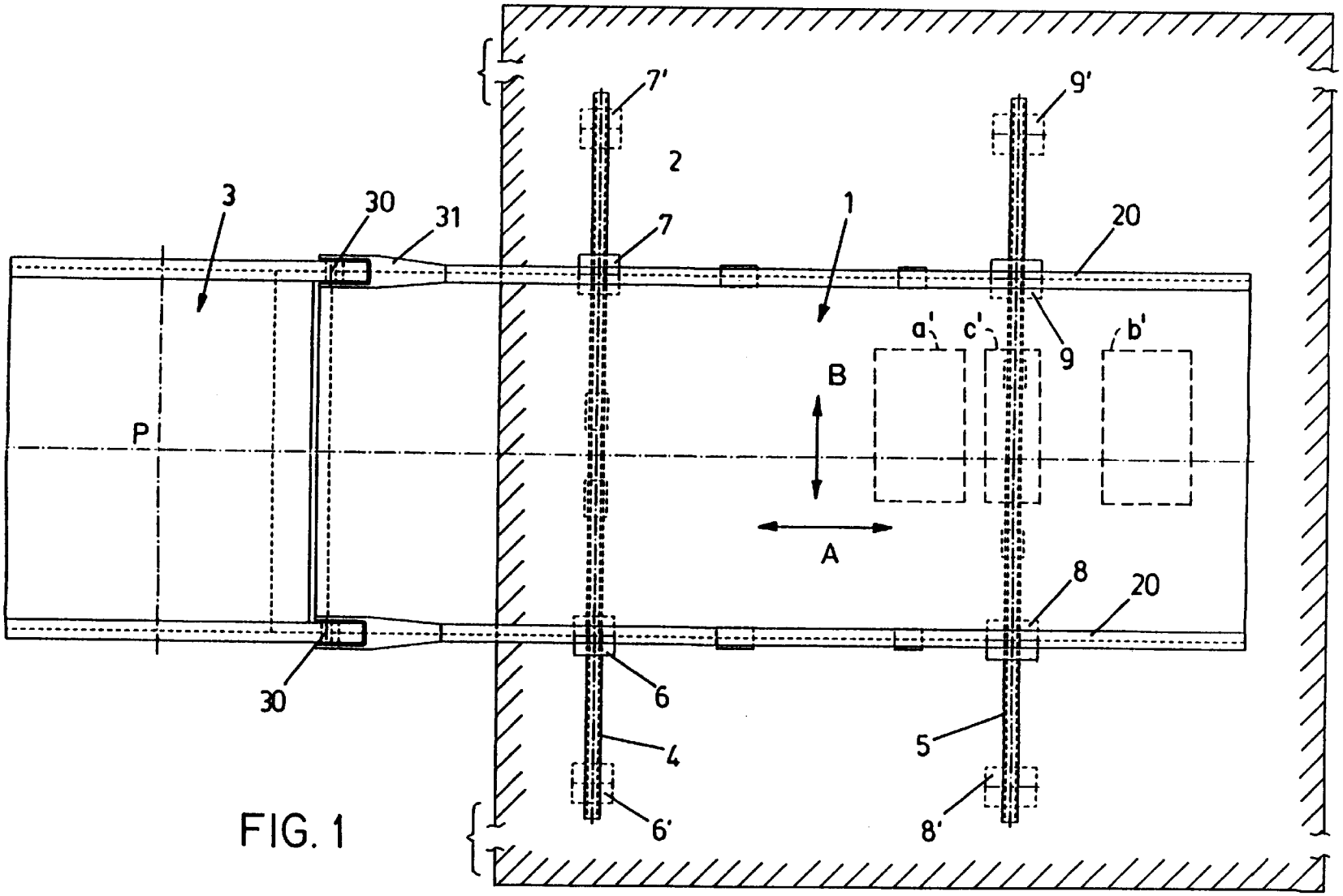
FIG. 1 is a top plan view of a cantilever according to the invention.

FIG. 1 is a top plan view of a cantilever 1 which, relative to a jack-up platform 2, is movable in its longitudinal direction as indicated by the arrow A, and in its transverse direction as indicated by the arrow B. The cantilever 1 and the jack-up platform 2 form part of a drilling rig capable of being moved by tugs to a specific location at sea, after which the jack-up platform can be positioned on the seabed by posts that can be moved downwards. Located on the jack-up platform are various spaces, accommodations, cranes, a helicopter platform, equipment and further accessories that may be important for a marine drilling rig. Located on the cantilever 1 is the drilling platform 3 with the derrick, the blow-out valve and further equipment, tools and materials required for drilling. In the embodiment according to the invention, the drilling platform 3 is fixedly arranged relative to the cantilever 1 and hence moves along therewith in the directions indicated by the arrows A and B. Provided on the deck of the jack-up platform 2 are rails 4 and 5 extending in the direction B. Over the rail 4, supporting members 6 and 7 are movable and over the rail 5, supporting members 8 and 9 are movable. These supporting members act as carriers for the cantilever 1; the cantilever 1 is movable over these supporting members in the direction A. Hence, with the interposition of the supporting members 6–9, the cantilever 1 is movable back and forth along the edge of the jack-up platform 2 through a distance determined by the end positions 6', 7', 8' and 9' that can be reached by the supporting members over the rails 4 and 5, and further over the supporting members 6–9 into a position in which the drilling platform 3 more or less projects outside the jack-up platform 2. Through the movement that can be made by the cantilever 1 with the drilling platform 3 positioned thereon, a rectangle is described centrally below the drilling platform 3 within which rectangle the drilling pattern will be located. The point from which the drilling takes place is indicated by P in FIG. 1; by moving the cantilever in the directions A and B, this drilling point P can be moved to all desired locations within said rectangle and the desired number of drillings at the desired mutual distances can take place. The size of the drilling pattern can be enlarged by increasing said rectangle or, in other words, by increasing the distance through which the cantilever 1 can be shifted in the directions A and B.

Figure 2:
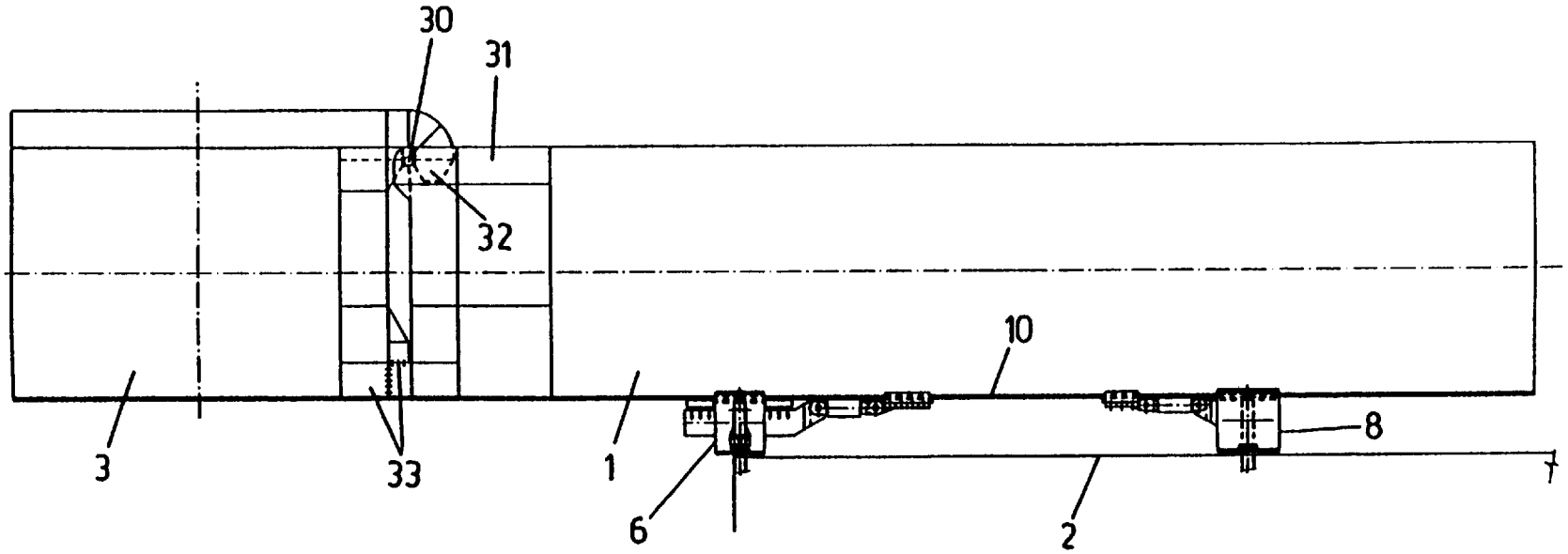
FIG. 2 is a side elevation of this cantilever.
Figure 3:
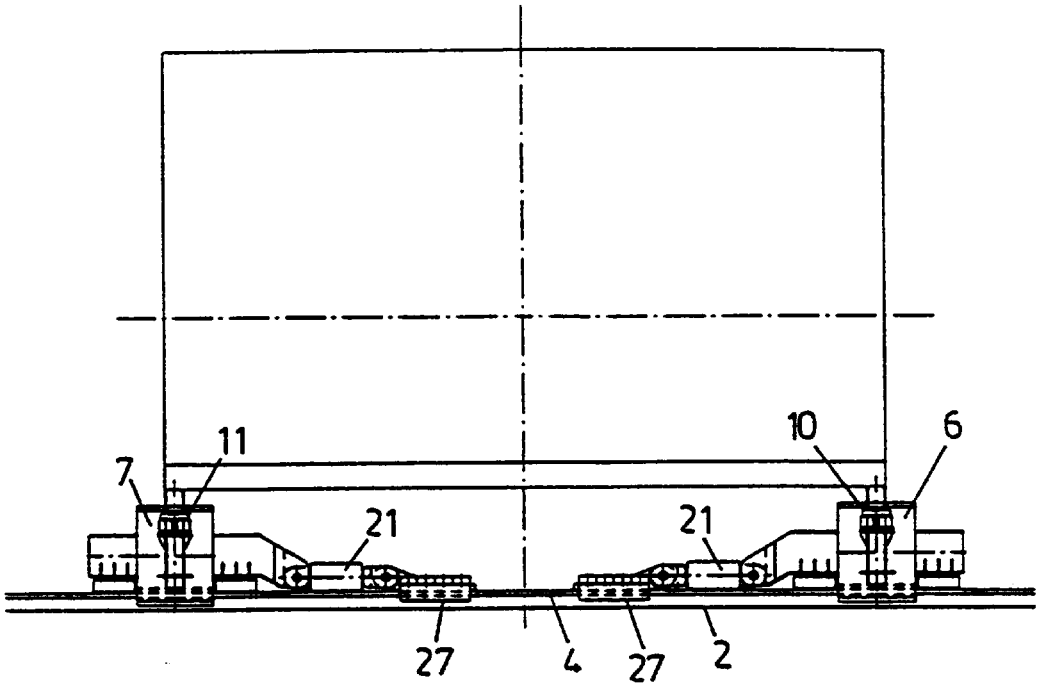
FIG. 3 is a rear view, i.e. a view from the side facing away from the jack-up platform.
Figure 4:
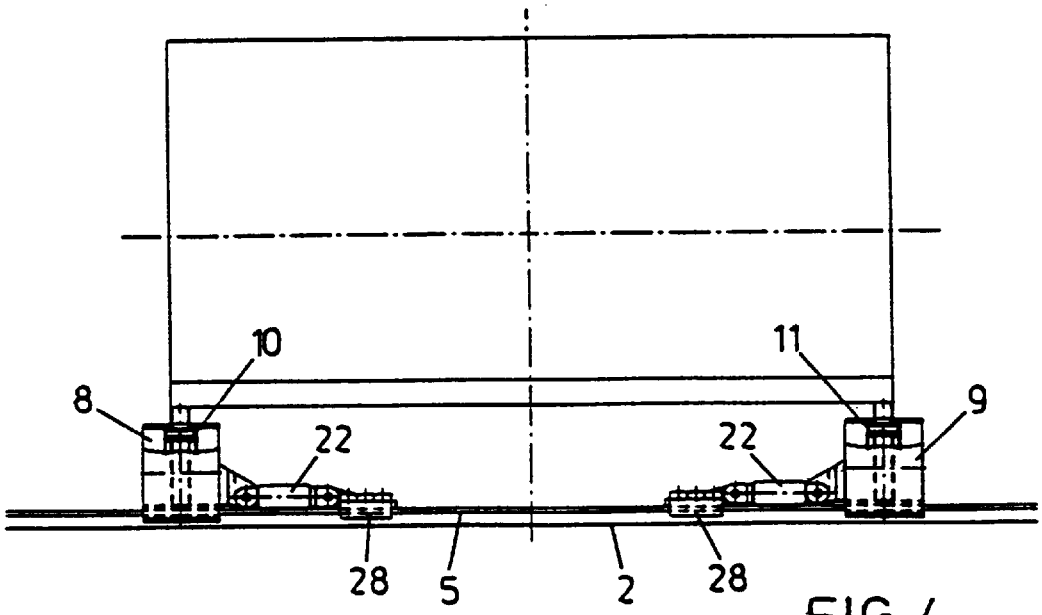
FIG. 4 is a front view, i.e. a view from the side facing the jack-up platform.
Figure 5:
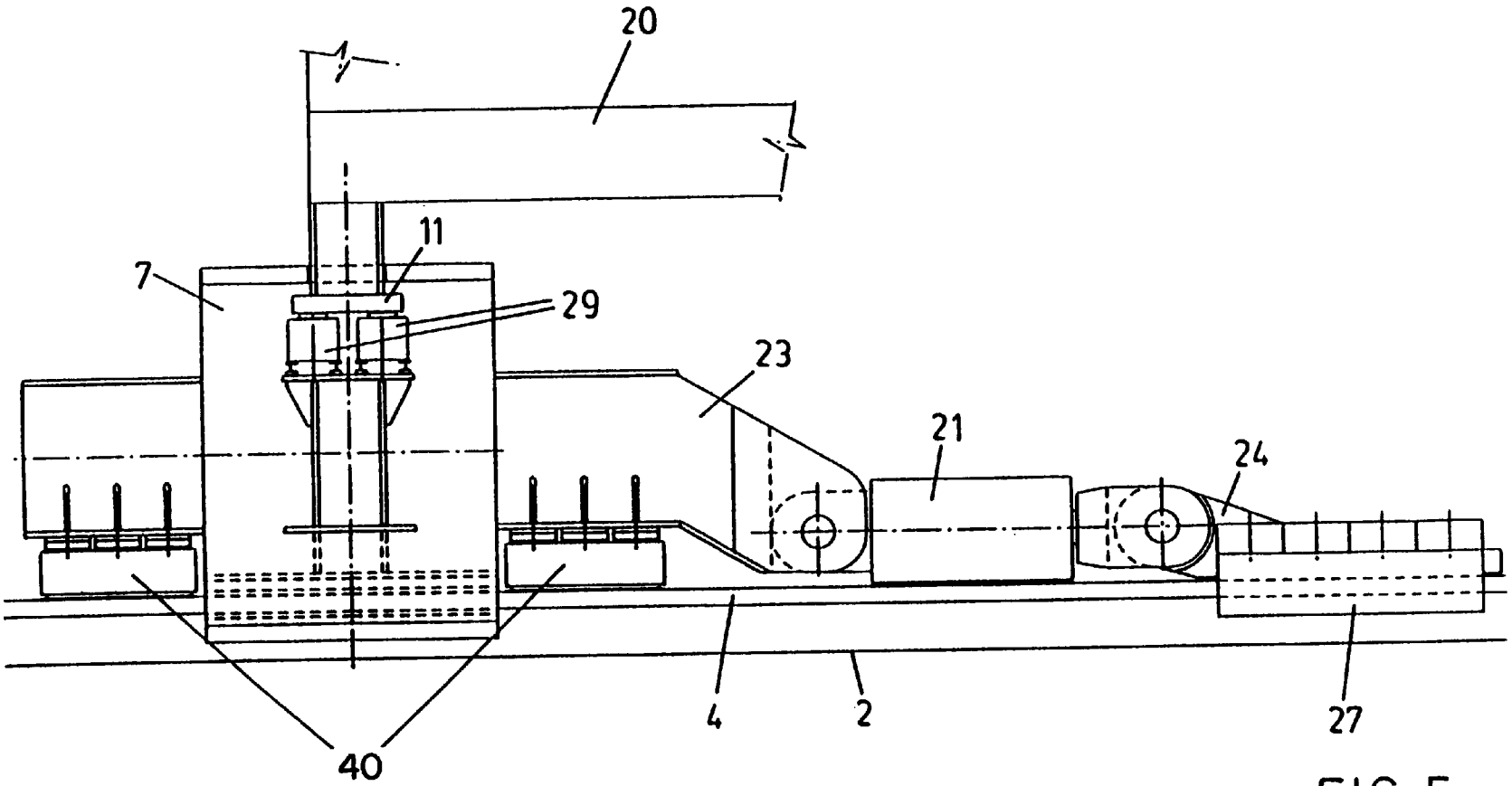
FIG. 5 is an enlarged view of a supporting member as visible from the rear view represented in FIG. 3.
Figure 6:
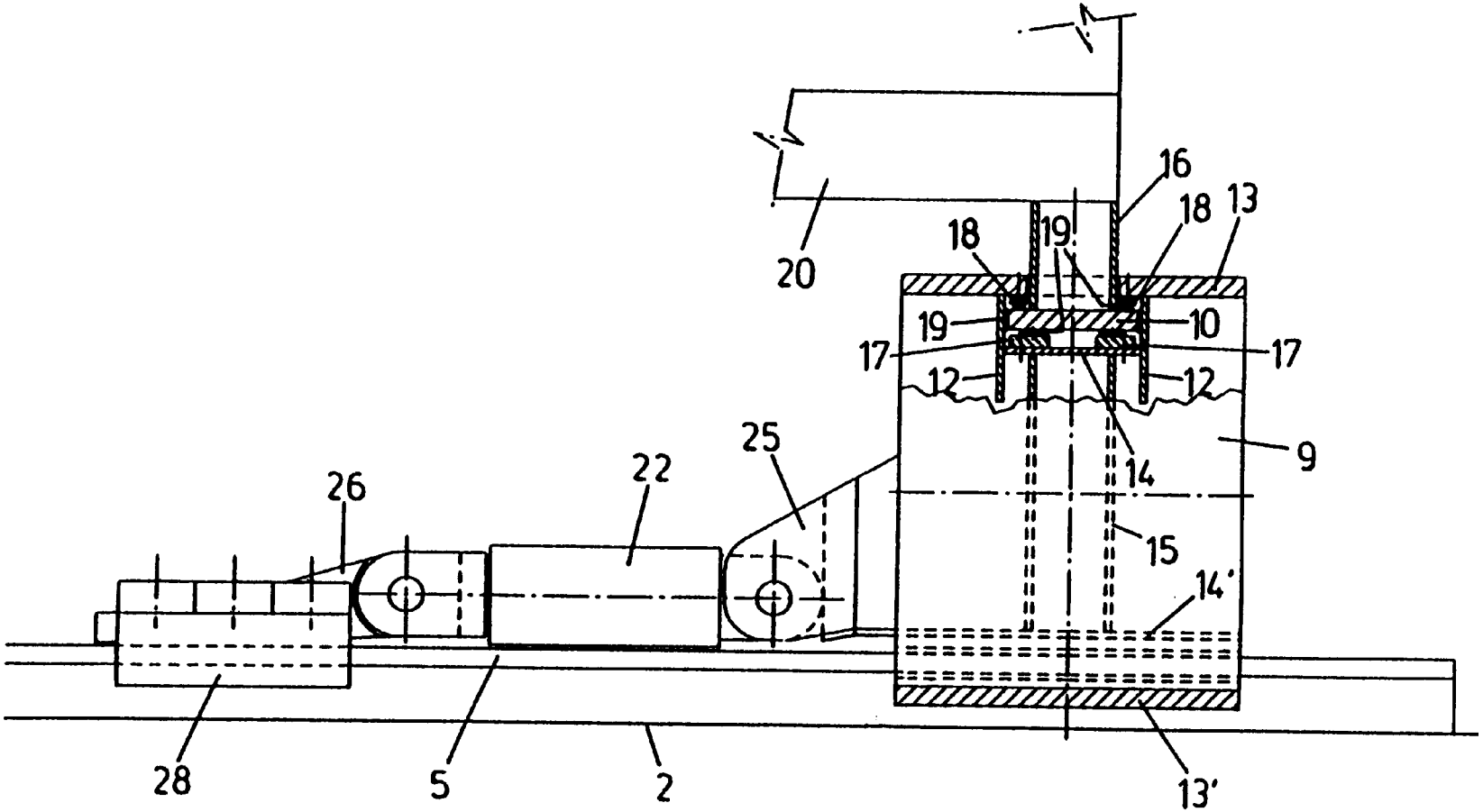
FIG. 6 is an enlarged view of a supporting member as visible from the front view represented in FIG. 4.
Figure 7:
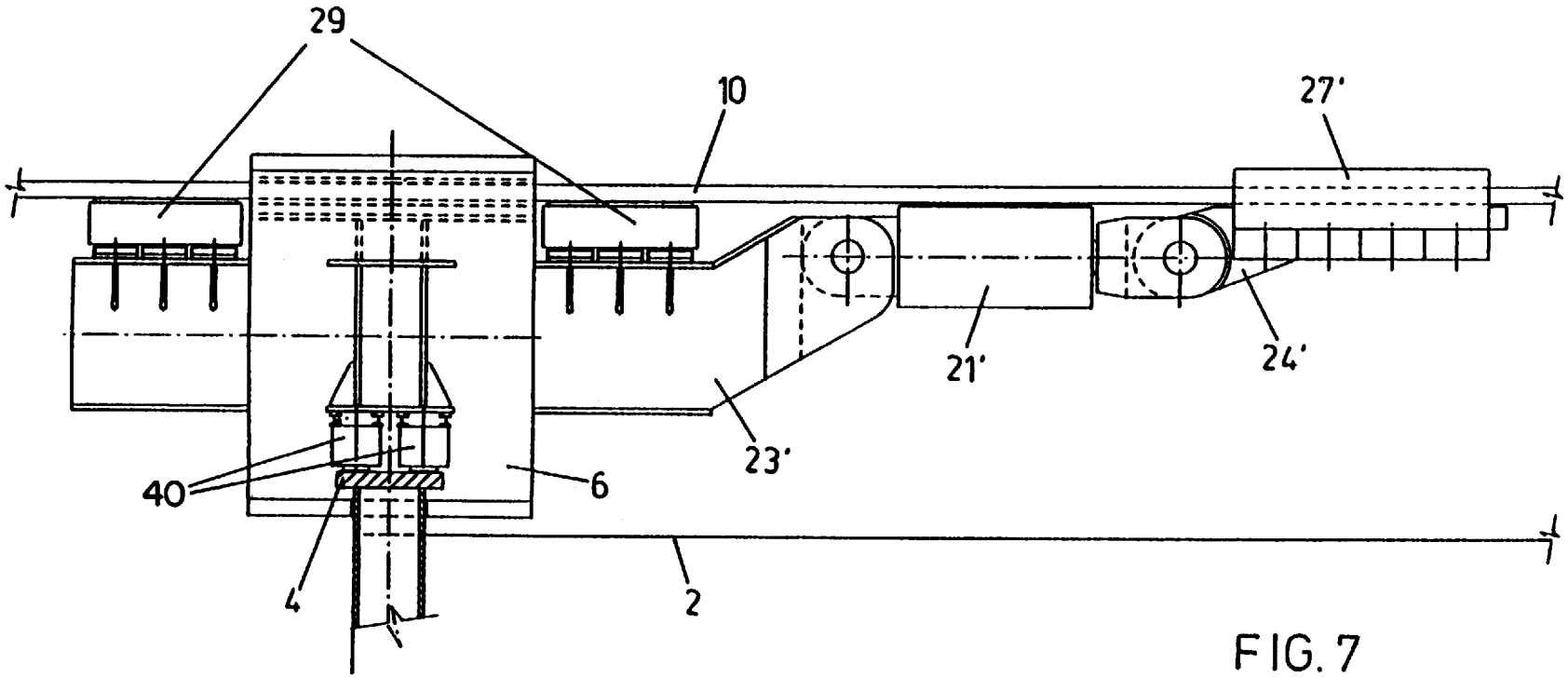
FIGS. 7 and 8 are each an enlarged view of a supporting member visible to the left and to the right respectively in the side elevation represented in FIG. 2.
Figure 8:
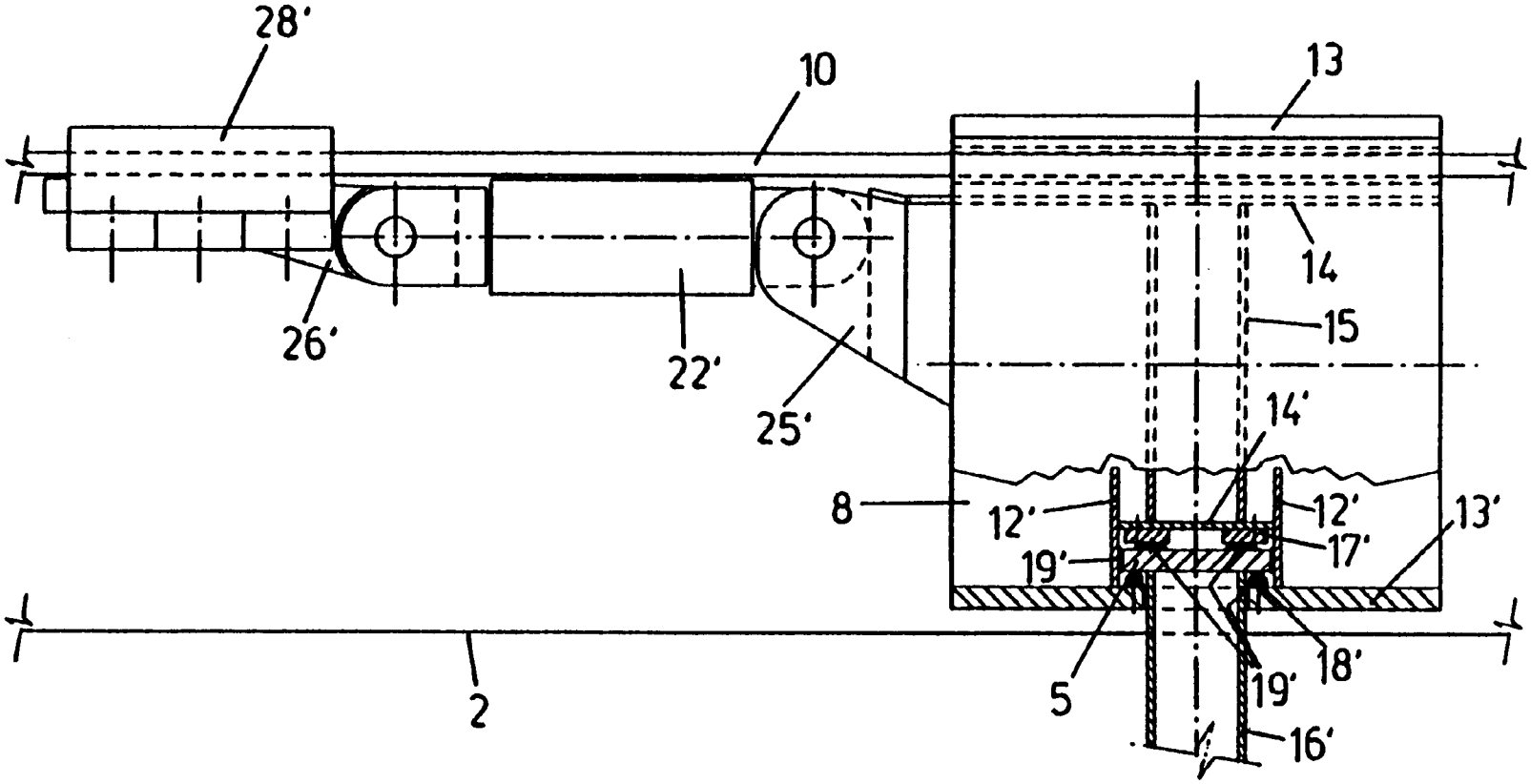

The means whereby the supporting members 6 and 7 can be shifted over the rail 4 are indicated in the rear view given in FIG. 3, while one of these means is depicted in an enlarged view in FIG. 5. The means whereby the supporting members 8 and 9 can be shifted over the rail 5 are indicated in the front view given in FIG. 4, while one of these means is depicted in an enlarged view in FIG. 6. The means whereby the cantilever 2 can be shifted over the supporting members 6, 7 and 8, 9 are indicated in the side elevation given in FIG. 2, while these means are depicted in an enlarged view in FIGS. 7 and 8 respectively. The cantilever 2 is shifted over the supporting members 6–9 by means of rails 10 and 11 arranged under the cantilever. The manner in which the supporting members 6–9 slide over the rails 4 and 5 and the manner in which the rails 10 and 11 slide over the supporting members 6–9 is always the same, to the effect that the slide means for the rails 10 and 11 are provided in the supporting members so as to be rotated through 90° relative to the slide means for the rails 4 and 5. These slide means are formed by vertical side plates 12 (FIG. 6) and 12' (FIG. 8) respectively, mounted below and against a deck plate 13 and on a bottom plate 13' respectively, between which side plates 12, 12' a horizontal plate 14, respectively 14' is provided. The plates 14 and 14' are fixedly interconnected by a tubular section 15 extending through the supporting members. Both in the deck plate 13 and in the bottom plate 13', a slot has been provided through which the supports 16 and 16' respectively for the rails 10, 11 and 4, 5 respectively pass. The plates 12, 13 and 14 constitute a housing through which the rails 10, 11 of the cantilever 2 can move. Provided in this housing are support plates 17 and 18, which, like the plates 12, comprise slide plates 19. The rails 10 and 11 are movable through the supporting members 6–9 while contacting these slide plates. The slide plates 19 are made from a material having good wear and corrosion properties, preferably an aluminum-bronze alloy. In the same manner, the plates 12', 13' and 14' constitute a housing whereby the supporting members can move over the rails 4, 5. In this housing, too, support plates 17' and 18' are again provided, which, like the plates 12', comprise slide plates 19' of the same material as the slide plates 19.

By means of the supports 16', the rails 4, 5 are secured on the jack-up platform 2, while by means of the supports 16, the rails 10, 11 are secured on the side beams 20 thereof extending in the longitudinal direction of the cantilever.

The supporting members 6–9 are shifted in the transverse direction by hydraulic cylinders 21, 22, activated in synchronization. By means of connecting pieces 23, 24, 25 and 26, these operating cylinders are arranged between the relevant supporting members 6–9 and slide members 27, 28 which can be secured on the rails 4, 5. Here, these slide members are constructed as a slide block which can be secured on the rails 4, 5 or released from these rails respectively by a number of hydraulic cylinders. Likewise, the cantilever is shifted in the longitudinal direction over the supporting members by hydraulic cylinders 21', 22' activated in synchronization. These operating cylinders, too, are arranged by means of connecting pieces 23', 24', 25' and 26' between the relevant supporting members 6–9 and slide members 27', 28' which can be secured on the rails 10, 11. These slide members 27', 28' are again identical to the slide members 27 and 28 respectively. In FIGS. 5–8, the operating cylinders are all shown in their retracted positions.

When in FIGS. 3 and 4 the slide members 27 and 28 have been secured on the rails 4 and 5 respectively, and the cylinders on the left-hand side are retracted while the cylinders on the right-hand side are extended, the supporting members 7–9 will, through the extension of the cylinders on the left-hand side in synchronization with the retraction of the cylinders on the right-hand side, be moved leftwards through a distance corresponding to the travel of the cylinders. When the slide members 27 and 28 are subsequently released relative to the rails 4 and 5, and the cylinders on the left-hand side are extended, in synchronization with the retraction of the cylinders on the right-hand side, the slide members 27, 28 are shifted rightwards through a distance corresponding to the travel of the cylinders. After that, the slide members can again be secured on the relevant rails and the supporting members can again be displaced. In this manner, the supporting members and, accordingly, the cantilever can be displaced stepwise in transverse direction. By operating the slide members 27' and 28' and the cylinders 21' and 22' in the same manner, the cantilever can be displaced stepwise over the supporting members 6–9 in the longitudinal direction.

Because of the weight of the drilling platform with accessories, reactive forces will occur in the supporting members. These reactive forces will be considerably greater in the supporting members 6 and 7 than in the supporting members 8 and 9. As a consequence, the frictional forces experienced by the supporting members 6 and 7 during shifting over the rail 4 and the frictional forces occurring in these supporting members during a displacement of the cantilever in the longitudinal direction will be considerably greater than the frictional forces experienced by the supporting members 8 and 9 during shifting over the rail 5, respectively the frictional forces occurring in the latter supporting members during a displacement of the cantilever in the longitudinal direction. For this reason, the supporting members 6 and 7 are provided with friction-reducing means 40 and 29 which are operative both in the longitudinal direction and in the transverse direction (see FIGS. 5 and 7). These friction-reducing means are formed by pairs of rollers which are freely movable between the supporting members 6 and 7 and the rails 4, 10 and 11 in the direction of the rails and pressed thereagainst. The pressure exerted by these pairs of rollers on the relevant rails is hydraulically settable.

Although the drilling platform may be fixedly connected to the cantilever, the drilling platform 3 shown in the present exemplary embodiment is detachably connected to the cantilever 2. The drilling platform 3 is at the top side hooked on the cantilever 2 around shafts 30 which are both arranged in a space at the end of an upper beam 31 of the cantilever. For this purpose, the drilling platform 3 is provided, at the top side thereof, with a forwardly and downwardly extending portion 32 movable over these shafts, while in the coupled condition the drilling platform 3 finds support, by its bottom side, against the cantilever and can at the support location 33 be bolted against the cantilever 1. Because of the height-movability of the jack-up platform and the movability of the cantilever 2 in the directions A and B, the drilling platform can accurately be positioned above a separate support platform and be placed thereon.

The movability of the cantilever and the fixed positioning thereon of the drilling platform render it more attractive to place the high-pressure dredge pumps conventional in drilling rigs on the cantilever. Now, flexible high-pressure lines are entirely avoided. Between the jack-up platform and the cantilever, low-pressure connections are now sufficient; fixedly mounted on the cantilever, they extend in the longitudinal direction towards the drilling platform.

The invention is by no means limited to the exemplary embodiment described hereinabove, but comprises various modifications hereto, in so far as they fall within the scope of the following claims.

What is claimed is:

1. A drilling rig capable of being used offshore, comprising a jack-up platform which a cantilever is mounted so as to be movable at least substantially horizontally in a longitudinal direction of the cantilever, with the cantilever in a drilling position projecting outside the jack-up platform, while a drilling platform is mounted on the cantilever, said drilling platform being movable relative to the jack-up platform in a direction transverse thereto, wherein the drilling platform is fixedly mounted on a distal end of the cantilever and said cantilever is movable relative to the jack-up platform in both of the above said directions, wherein supporting members for the cantilever are present, said supporting members are movable with the cantilever in the transverse direction over rails secured on the jack-up platform, while the cantilever is supported by the supporting members for movement in the longitudinal direction.

2. A drilling rig according to claim 1, wherein by means of relevant operating cylinders, the supporting members are slidable over the rails secured on the jack-up platform and extending in the transverse direction, relative to slide members which can be secured on said rails, when said slide members are at least secured thereon.

3. A drilling rig comprising a jack-up platform on which a cantilever is mounted so as to be movable at least substantially horizontally and in a first direction, with the cantilever projecting outside the jack-up platform, while a drilling platform is mounted on the cantilever, said drilling platform being movable relative to the jack-up platform in a second direction, different from the first direction, wherein the drilling platform is fixedly mounted on the cantilever and said cantilever is movable relative to the jack-up platform in both the above said directions, wherein the cantilever is movable in the longitudinal direction of the cantilever, with the cantilever projecting more or less outside the jack-up platform, and is arranged relative to the jack-up platform in a direction transverse thereto, wherein supporting members for the cantilever are present, said supporting members being movable with the cantilever in the transverse direction over rails secured on the jack-up platform. while the cantilever is supported by the supporting members for movement in the longitudinal direction, at least the two supporting members that are movable over the rail located closest to the edge of the jack-up platform are provided with friction-reducing means operative both in the longitudinal direction and in the transverse direction, for taking up at least a part of the frictional forces between the supporting members and the relevant rail and between the rails of the cantilever and the relevant supporting members.

4. A drilling rig according to claim 3, wherein the friction-reducing means are formed by pairs of rollers which are freely movable between the supporting members and the rails in the direction of the rails and pressed therein against.

5. A drilling rig according to claim 4, wherein the pressure exerted on the relevant rails by the friction-reducing means is capable of being set to a pre-selected pressure.

6. A drilling rig according to claim 3, wherein the pressure exerted on the relevant rails by the friction-reducing means is capable of being set to a pre-selected pressure.

7. A drilling rig according to claim 3, wherein coupling means are present by means of which the drilling platform is detachably connected to the cantilever so that the drilling platform can be positioned on a separate support platform.

8. A drilling rig according to claim 3, wherein the drilling rig further comprises high-pressure dredge pumps and arranged on the cantilever.

9. A drilling rig capable of being used offshore, comprising a jack-up platform on which a cantilever is mounted so as to be movable at least substantially horizontally and in a first direction, with the cantilever projecting outside the jack-up platform, while a drilling platform is mounted on the cantilever, said drilling platform being movable relative to the jack-up platform in a second direction, different from the first direction, wherein the drilling platform is fixedly mounted on the cantilever and said cantilever is movable relative to the jack-up platform in both the above said directions, wherein the cantilever is movable in the longitudinal direction of the cantilever, with the cantilever projecting more or less outside the jack-up platform, and is arranged relative to the jack-up platform in a direction transverse thereto, wherein by means a relevant operating cylinders, the supporting members supporting the cantilever are slidable over the rail secured on the jack-up platform and extending in the transverse direction, relative to slide members which can be secured on said rails, when said slide members are at least secured thereon, wherein at least the two supporting members that are movable over the rails located closest to the edge of the jack-up platform are provided with friction-reducing means operative both in the longitudinal direction and in the transverse directions, to take up at least a part of the frictional forces between the supporting members and the relevant rail and between the rails of the cantilever and the relevant supporting members.

10. A drilling rig according to claim 9, wherein the friction-reducing means are formed by pairs of rollers which are freely movable between the supporting members and the rails in the direction of the rails and pressed thereagainst.

11. A drilling rig according to claim 10, wherein the pressure exerted on the relevant rails by the friction-reducing means is capable of being set to a pre-selected pressure.

12. A drilling rig according to claim 9, wherein coupling means are present by means of which the drilling platform is detachably connected to the cantilever so that the drilling platform can be positioned on a separate support platform.

13. A drilling rig according to claim 9, wherein the drilling rig further comprises high-pressure dredge pumps and arranged on the cantilever.

* * * * *